US005118251A

United States Patent [19]

Saulgeot

[11] Patent Number: 5,118,251

[45] Date of Patent: Jun. 2, 1992

[54] COMPOUND TURBOMOLECULAR VACUUM PUMP HAVING TWO ROTARY SHAFTS AND DELIVERING TO ATMOSPHERIC PRESSURE

[75] Inventor: Claude Saulgeot, Veyrier du Lac, France

[73] Assignee: Alcatel CIT, Paris, France

[21] Appl. No.: 634,623

[22] Filed: Dec. 27, 1990

[30] Foreign Application Priority Data

Dec. 28, 1989 [FR] France ..... 89 17343

[51] Int. Cl.[5] ..... F04D 19/04; F04B 41/06

[52] U.S. Cl. ..... 415/90; 417/423.4; 417/203; 417/205

[58] Field of Search ..... 415/89, 90; 417/201, 417/203, 205, 423.4

[56] References Cited

FOREIGN PATENT DOCUMENTS

| | | | |
|---|---|---|---|
| 2833954 | 2/1980 | Fed. Rep. of Germany | 415/90 |
| 145394 | 7/1986 | Japan | 415/90 |
| 75386 | 4/1988 | Japan | 415/90 |
| 75390 | 4/1988 | Japan | 415/90 |
| 147989 | 6/1988 | Japan | 415/90 |
| 147990 | 6/1988 | Japan | 415/90 |
| 2189295 | 10/1987 | United Kingdom | 415/90 |

*Primary Examiner*—Edward K. Look
*Assistant Examiner*—Michael S. Lee
*Attorney, Agent, or Firm*—Sughrue, Mion, Zinn Macpeak & Seas

[57] ABSTRACT

A pump enabling a molecular vacuum to be reached, the pump comprising a stator and rotor assembly comprising two rotors having parallel shafts rotating in opposite directions, the stator including a suction inlet and a delivery outlet, wherein the pump is split axially into a first zone situated at its suction end, followed by a second zone, said first zone being of the turbomolecular type having fins and two rotors, said second zone being of the type having two screws or two rotary pistons on parallel shafts, one of the shafts being driven by a motor and the other being driven by a transmission.

4 Claims, 3 Drawing Sheets

COMPOUND TURBOMOLECULAR VACUUM PUMP HAVING TWO ROTARY SHAFTS AND DELIVERING TO ATMOSPHERIC PRESSURE

In order to achieve a vacuum having a pressure of less than $10^{-2}$ mbars while delivering to atmospheric pressure, it is present practice to use a pump assembly comprising a primary pump delivering to the atmosphere and a secondary pump delivering to the suction pressure of the primary pump.

BACKGROUND OF THE INVENTION

The same applies to certain industrial processes where the pressure inside the chamber in which the process is performed need not be as low as that, being as much as a few mbars, but where it is necessary to extract a certain flow rate of process gas while maintaining said pressure, since at said pressure the flow rate of a primary pump is very low and use is therefore also made of a pump assembly comprising a secondary pump and a primary pump. The primary pump and the secondary pump have their own respective drive motors.

The object of the present invention is to provide a unit pump assembly having a single drive motor and capable of delivering to the atmosphere while achieving a very high limiting vacuum at the suction end of down to $10^{-10}$ mbars.

SUMMARY OF THE INVENTION

The invention thus provides a pump enabling a molecular vacuum to be reached, the pump comprising a stator and rotor assembly comprising two rotors having parallel shafts rotating in opposite directions, the stator including a suction inlet and a delivery outlet, wherein the pump is split axially into a first zone situated at its suction end, followed by a second zone, said first zone being of the turbomolecular type having fins and two rotors, said second zone being of the type having two screws or two rotary pistons on parallel shafts, one of the shafts being driven by a motor and the other being driven by transmission means.

In a preferred embodiment of the invention, in the turbomolecular type pump zone, each shaft includes a sequence of finned disks, with the distance between the two shafts corresponding to about the radial length of a fin plus the diameter of the hub carrying it, the disks on one of the shafts being offset axially relative to the disks on the other shaft, the stator being provided with a stator finned diaphragm downstream from each rotor disk of the two rotors, such that each diaphragm following a rotor disk carried by one shaft lies in the same plane as a rotor disk carried by the other shaft, said diaphragm having a gap occupying a sector corresponding to the rotor space which is common to both stators and which is situated between the two shafts.

BRIEF DESCRIPTION OF THE DRAWINGS

An embodiment of the invention is described by way of example with reference to the accompanying drawings, in which.

DETAILED DESCRIPTION

Figure 1:
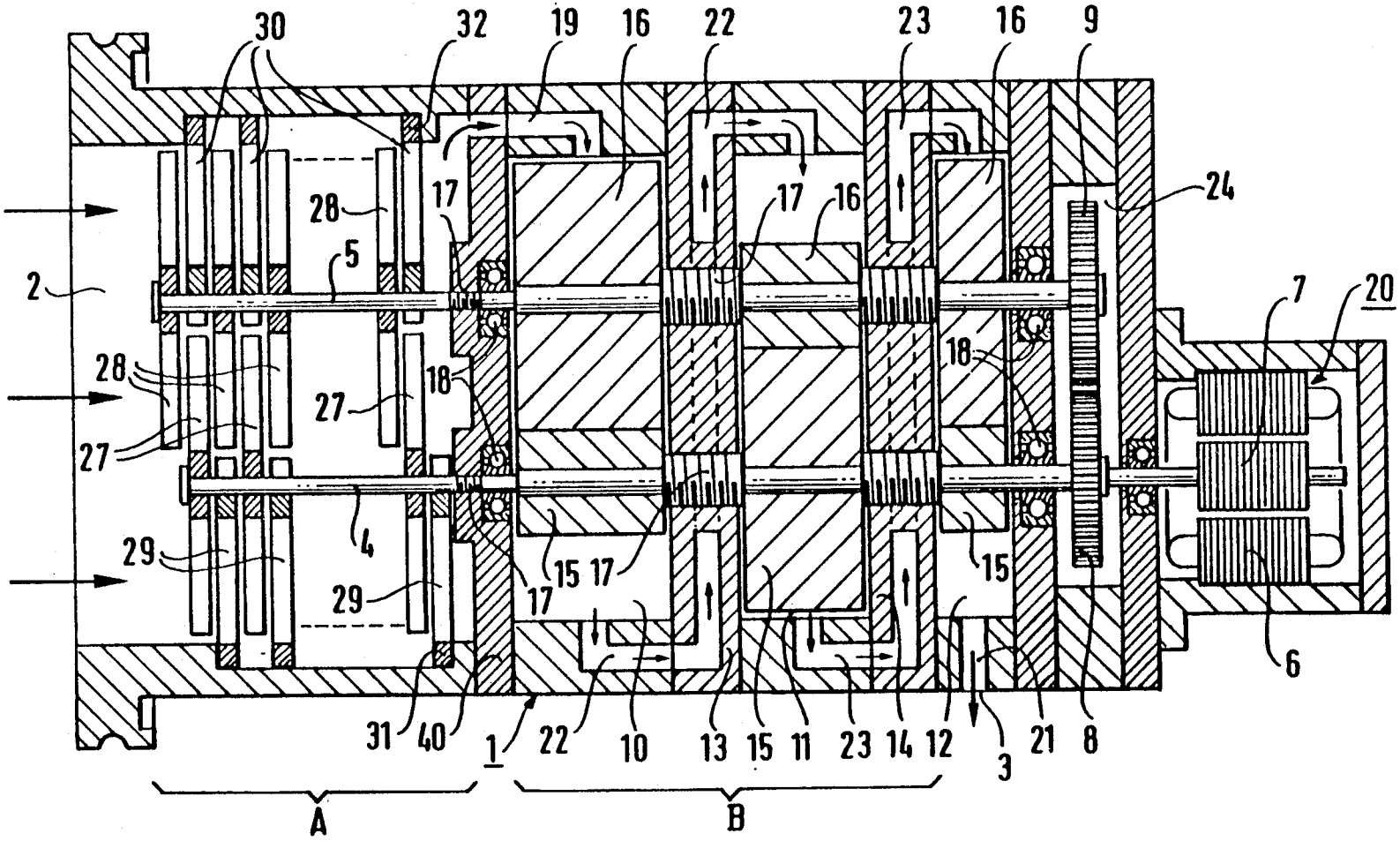
FIG. 1 is a diagram of a molecular vacuum pump of the invention.

With reference to FIG. 1, a molecular vacuum pump can be seen comprising a stator 1 having a suction inlet 2 and a delivery outlet 3. A rotor assembly having two rotors and two parallel shafts 4 and 5 rotating in opposite directions is situated inside the stator. The shaft 4 is driven by a drive motor 20 comprising a stator 6 and a rotor 7 which is fixed to the shaft 4. The shaft 5 is rotated in the opposite direction by gearing comprising two gear wheels 8 and 9.

The pump is split into two zones: a first zone A situated at its suction end; and a second zone B following the zone A.

The zone A acts as a secondary pump and is of the molecular drag or "turbomolecular" type, while the zone B acts as a primary pump and is of the Roots type. In the embodiment shown in FIG. 3, zone B is of the screw type while the zone A is identical to that shown in FIG. 1.

In FIG. 1, the Roots type pump of zone B comprises three stages 10, 11, and 12 separated by partitions 13 and 14. Each Roots stage is entirely conventional and naturally comprises a pair of rotary pistons 15 and 16.

Where they pass through the partitions 13 and 14, and also where they pass through a partition 40 separating the zone A from the zone B, the shafts 4 and 5 are fitted with dynamic seal type labyrinth glands 17. The set of two rotors is supported by ball bearings 18 mounted in the end walls of the zone B.

After delivery from the turbomolecular pump, suction in the first stage 10 takes place via an internal duct 19, and delivery at the outlet from the third and last stage 12 takes place via a duct 21 leading to the delivery orifice 3. Transit from the first stage 10 to the second stage 11, and from the second stage 11 to the third stage 12 takes place via respective internal ducts 22 and 23.

Figure 2:
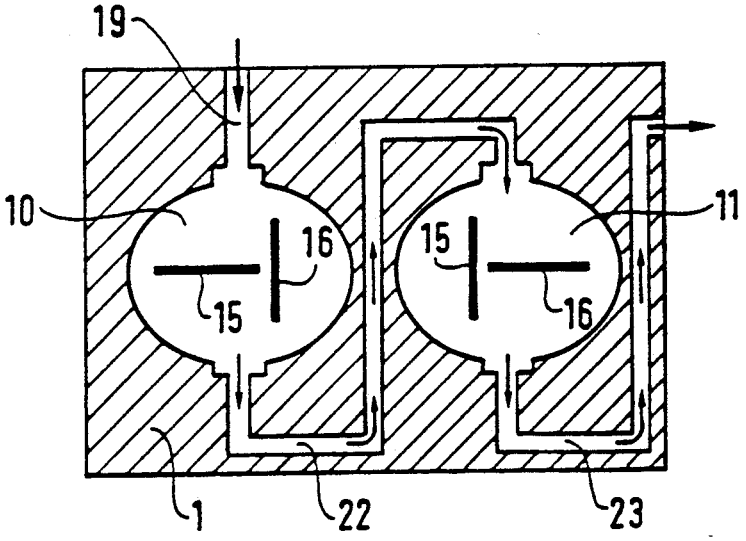
FIG. 2 is a diagram showing the flow of fluid from one stage to the other in the high pressure zone of the pump.
Figure 4:
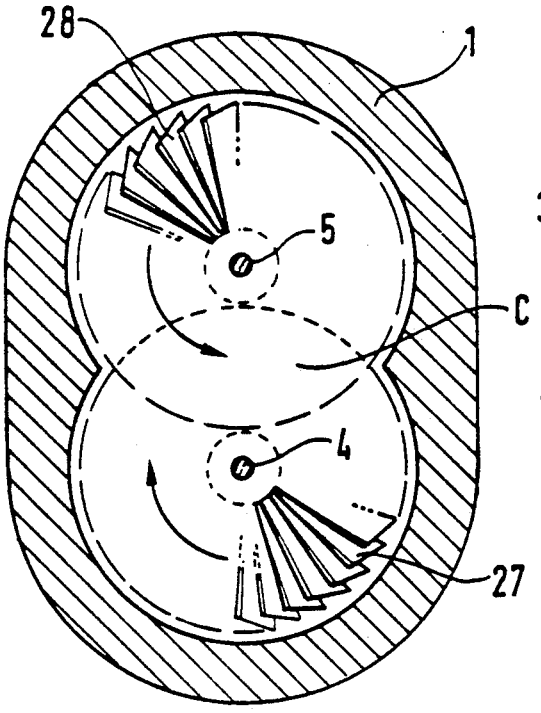
FIG. 4 shows the pump of FIG. 1 or FIG. 3 as seen end-on at its low pressure end.

FIG. 2 is a diagram illustrating two stages 10 and 11 in the zone B.

The synchronization gearing constituted by gear wheels 8 and 9 may be designed to run dry. Otherwise, the gear chamber 24 needs to be isolated both from the motor 20 and from the last stage 12 by lubricant seals.

Figure 3:
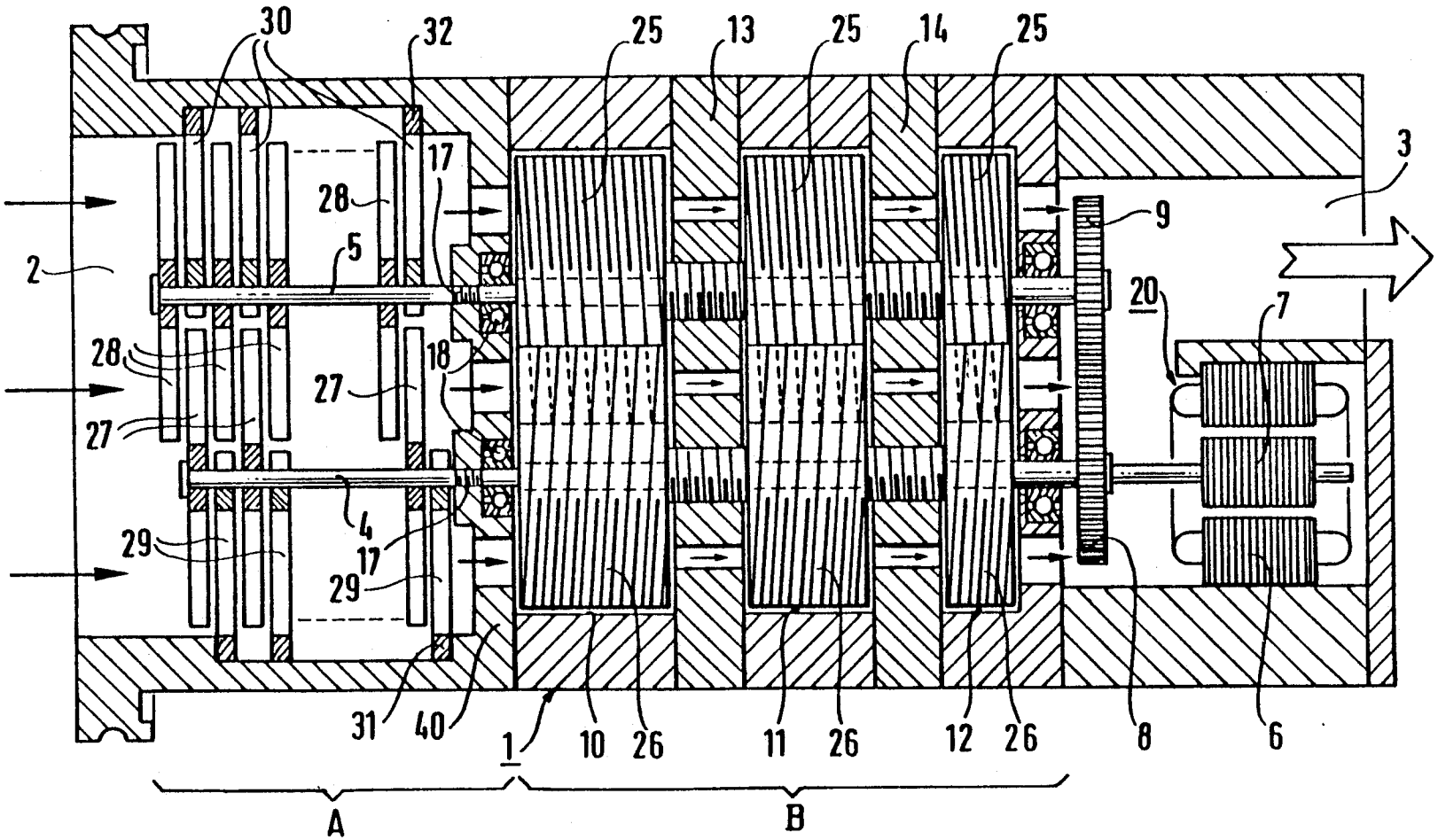
FIG. 3 is a variant of FIG. 1 in which the high pressure portion of the pump is of a different type.

In FIG. 3, the zone B is constituted by a screw pump likewise having three stages 10, 11, and 12. Each stage has two screw rotors 25 and 26, with admission and delivery being axial in this case.

Both FIGS. 1 and 3 have an identical zone A.

In zone A, the pump is of the turbomolecular type using fins and two rotors constituted by finned disks 27 for the first rotor on the shaft 4 and finned disks 28 for the second rotor on the shaft 5.

As can be seen in FIGS. 1 and 3, the disks 27 and 28 are offset axially since the distance between the two shafts 4 and 5 is insufficient to allow them to occupy the same planes. This distance corresponds to about the radial length of each disk fin plus the diameter of the hubs carrying the fins.

Downstream from each disk 27 or 28, the stator 1 is provided with a stator diaphragm, referenced 29 adjacent to the shaft 4 and referenced 30 adjacent to the shaft 5, said diaphragms having fins.

Figure 5:
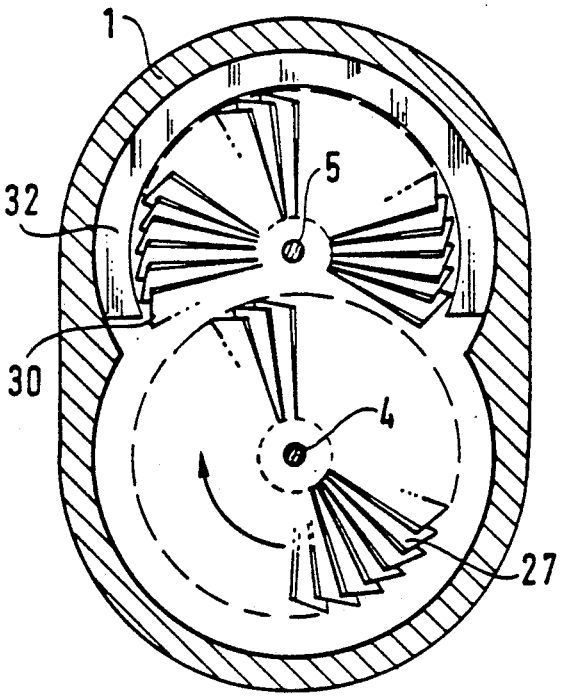
FIG. 5 shows a finned rotor disk and a finned stator diaphragm in their respective positions.

Each diaphragm 29 is situated in the same plane as one of the rotor disks 29, and each diaphragm 30 is situated in the same plane as one of the rotor disks 27. The diaphragms 29 and 30 are not complete disks, being interrupted by gaps each occupying a sector corresponding to the rotor space which is common to both stators in that portion of the pump lying between the shafts 4 and 5, as can clearly be seen in FIG. 5. Ends of the fins of the diaphragms 29 and 30 are fixed to corresponding rings 31 and 32 enabling them to be fixed to the stator 1.

A molecular pump is thus obtained which is capable of reaching a very high secondary vacuum while delivering to the atmosphere, having only one drive motor and capable of high flow rates while being compact. Its flow rate is comparable to that provided by two pumps (one primary and one secondary), but naturally its volume is smaller.

I claim:

1. A pump enabling a molecular vacuum to be reached, the pump comprising a stator and rotor assembly comprising two rotors having respective parallel shafts rotating in opposite directions, the stator including a suction inlet and a delivery outlet, wherein the pump is split axially into a first zone situated at a suction end, followed by a second zone, said first zone being of the turbomolecular type having fins on said two rotors, said second zone being of the type having two screws respectively on said parallel shafts, one of the shafts being driven by a motor and the other being driven by transmission means operatively coupled to said one shaft.

2. A molecular vacuum pump according to claim 1, wherein, in the first zone, each shaft includes a sequence of finned disks, with the distance between the two shafts corresponding to about the radial length of a fin of said finned disks plus the diameter of a hub carrying said fin, the finned disks on one of the shafts being offset axially relative to the finned disks on the other shaft, said stator being provided with a stator finned diaphragm downstream from each finned disk of said two rotors, such that each stator finned diaphragm follows a finned disk carried by said one shaft which lies in the same plane as a finned disk carried by the other shaft, said stator finned diaphragm having a gap occupying a sector corresponding to a rotor space which is common to both stators and which is situated between said two shafts.

3. A pump enabling a molecular vacuum to be reached, the pump comprising a stator and rotor assembly comprising two rotors having respective parallel shafts rotating in opposite directions, the stator including a suction inlet and a delivery outlet, wherein the pump is split axially into a first zone situated at a suction end, followed by a second zone, said first zone being of the turbomolecular type having fins on said two rotors, said second zone being of the type having two screws or two rotary pistons on said parallel shafts, one of the shafts being driven by a motor and the other being driven by transmission means operatively, coupled to said one shaft.

4. A molecular vacuum pump according to claim 3, wherein in the first zone, each shaft includes a sequence of finned disks, with the distance between the two shafts corresponding to the radial length of a fin of said finned disks plus the diameter of a hub carrying said fin, the finned disks on one of the shafts being offset axially relative to the finned disks on the other shaft, said stator being provided with a stator finned diaphragm downstream from each finned disk of said two rotors, such that each stator finned diaphragm follows a finned disk carried by said one shaft which lies in the same plane as a finned disk carried by the other shaft, said stator finned diaphragm having a gap occupying a sector corresponding to a rotor space which is common to both stators and which is situated between said two shafts.

* * * * *